US005151633A

United States Patent [19]

Farrall et al.

[11] Patent Number: 5,151,633

[45] Date of Patent: Sep. 29, 1992

[54] SELF-EXTINGUISHING GAS PROBE STARTER FOR AN ELECTRODELESS HIGH INTENSITY DISCHARGE LAMP

[75] Inventors: George A. Farrall, Rexford; John P. Cocoma, Clifton Park, both of N.Y.; James T. Dakin; Mark E. Duffy, both of Shaker Heights, Ohio; Tommie Berry, Jr., East Cleveland, Ohio

[73] Assignee: General Electric Company, Schenectady, N.Y.

[21] Appl. No.: 812,266

[22] Filed: Dec. 23, 1991

[51] Int. Cl.[5] ..... H05B 41/16

[52] U.S. Cl. ..... 315/248; 315/344; 313/637; 313/234

[58] Field of Search ..... 315/248, 344, 39, 262, 315/112, 150; 313/234, 607, 637-639, 25, 26

[56] References Cited

U.S. PATENT DOCUMENTS

| | | | |
|---|---|---|---|
| 4,743,807 | 5/1988 | Christophorou | 315/150 |
| 4,810,938 | 3/1989 | Johnson et al. | 315/248 |
| 4,812,702 | 3/1989 | Anderson | 313/153 |
| 4,937,500 | 6/1990 | Christophorou | 315/150 |
| 4,972,120 | 11/1990 | Witting | 315/248 |
| 5,039,903 | 8/1991 | Farrall | 315/160 |
| 5,057,750 | 10/1991 | Farrall et al. | 315/248 |
| 5,095,249 | 3/1992 | Roberts | 315/248 |
| 5,103,140 | 4/1992 | Cocoma | 315/248 |

OTHER PUBLICATIONS

Ingold, John H., "Glow Discharges at DC and Low Frequencies" from Gaseous Electronics, vol. 1, Academic Press, New York, 1978, pp. 19-20.

*Primary Examiner*—Eugene R. LaRoche
*Assistant Examiner*—A. Zarabian
*Attorney, Agent, or Firm*—Jill M. Breedlove; James C. Davis, Jr.; Marvin Snyder

[57] ABSTRACT

The fill of a self-extinguishing gas probe starter for an electrodeless high intensity discharge lamp includes a starter fill component which has a relatively low vapor pressure and is substantially inert in the starter fill at ambient temperatures, but which component vaporizes and becomes electronegative as the temperature of the lamp increases, so that the starter fill component attaches electrons of the starting discharge in the gas probe starter and thereby extinguishes the starting discharge after initiation of the arc discharge in the arc tube. As a result, the flow of currents between the gas probe starter and the arc tube, which would otherwise have a detrimental effect on the arc tube wall, is avoided.

13 Claims, 1 Drawing Sheet

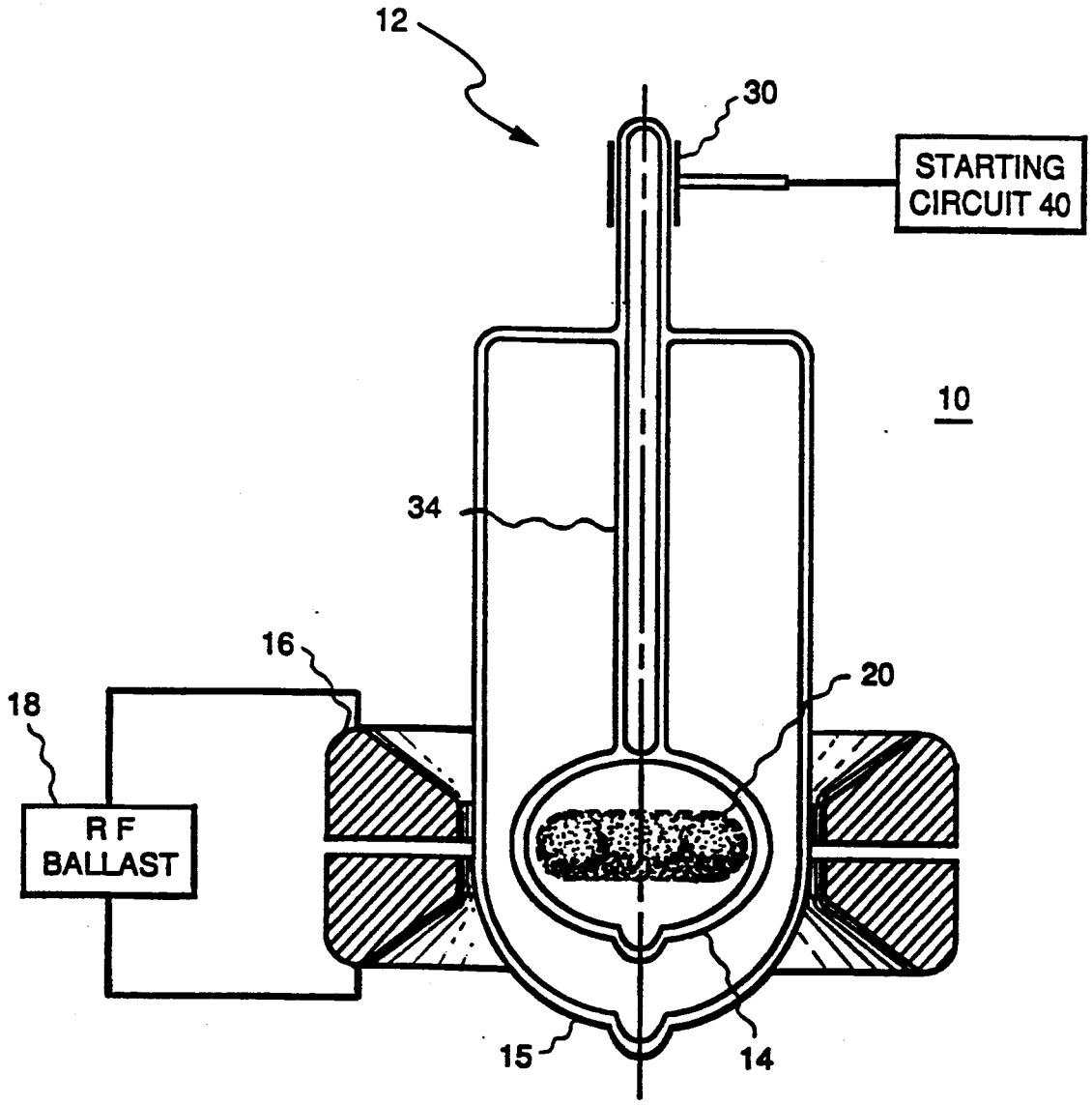
12
30
STARTING CIRCUIT 40
10
34
16
20
18
R F BALLAST
15
14

SELF-EXTINGUISHING GAS PROBE STARTER FOR AN ELECTRODELESS HIGH INTENSITY DISCHARGE LAMP

FIELD OF THE INVENTION

The present invention relates generally to electrodeless high intensity discharge lamps and, more particularly, to a self-extinguishing gas probe starter therefor.

BACKGROUND OF THE INVENTION

In a high intensity discharge (HID) lamp, a medium to high pressure ionizable gas, such as mercury or sodium vapor, emits visible radiation upon excitation caused by passage of current through the gas. One class of HID lamps comprises inductively-coupled electrodeless lamps which generate an arc discharge by generating a solenoidal electric field in a high-pressure gaseous lamp fill. In particular, the lamp fill, or discharge plasma, is excited by radio frequency (RF) current in an excitation coil surrounding an arc tube. The arc tube and excitation coil assembly acts essentially as a transformer which couples RF energy to the plasma. That is, the excitation coil acts as a primary coil, and the plasma functions as a single-turn secondary. RF current in the excitation coil produces a time-varying magnetic field, in turn creating an electric field in the plasma which closes completely upon itself, i.e., a solenoidal electric field. Current flows as a result of this electric field, resulting in a toroidal arc discharge in the arc tube.

At room temperature, the solenoidal electric field produced by the excitation coil is typically not high enough to ionize the gaseous fill and thus initiate the arc discharge. One way to overcome this shortcoming is to lower the gas pressure of the fill, for example, by first immersing the arc tube in liquid nitrogen so that the gas temperature is decreased to a very low value and then allowing the gas temperature to increase. As the temperature rises, an optimum gas density is eventually reached for ionization, or breakdown, of the fill to occur so that an arc discharge is initiated. However, the liquid nitrogen method of initiating an arc discharge is not practical for widespread commercial use.

A recently developed starting aid for an electrodeless HID lamp is a gas probe starter, such as that described in commonly assigned, copending U.S. patent application Ser. No. 622,247, of V. D. Roberts et al., filed Dec. 4, 1990, now allowed, which is incorporated by reference herein. The gas probe starter of Roberts et al. includes a fixed starting electrode coupled to a starting chamber which is attached to the arc tube and contains a gas. Preferably, the gas in the starting chamber is at a relatively low pressure as compared with that of the arc tube fill. In the chamber, the gas may be switched between conducting and nonconducting states corresponding to lamp-starting and normal running operation, respectively. In particular, during lamp-starting, a starting voltage is applied to the starting electrode, which causes the gas in the chamber to become conductive. As a result, a sufficiently high voltage is capacitively coupled to the inside surface of the arc tube to break down the gaseous fill contained therein, thus initiating an arc discharge.

A suitable starting circuit for coupling a starting voltage to a gas probe starter is described in commonly assigned, copending U.S. patent application of Cocoma et al., Ser. No. 622,024, filed Dec. 4, 1990, which comprises a resonant LC circuit of variable impedance.

Upon application of an RF signal to the excitation coil of the lamp, the starting circuit of Cocoma et al., Ser. No. 622,024, resonates to a sufficiently high voltage to initiate a discharge in the starting chamber which is capacitively coupled to the arc tube, thereby initiating an arc discharge therein. In another suitable alternative starting circuit, as described in U.S. Pat. No. 5,057,750 of G. A. Farrall et al., issued Oct. 15, 1991, the resonant circuit is retuned after initiation of the discharge in the starting chamber in order to ensure that a sufficiently high voltage is applied to the arc tube for initiating the arc discharge, even in relatively low-energy circuits. The Cocoma et al. application and Farrall et al. patent are incorporated by reference herein.

The starting circuits of the above cited references further describe coupling a switch, or a parallel combination of a switch and an additional resonant circuit, in series with the resonant inductor of a Class-D type ballast to ensure suppression of the discharge in the low-pressure starting chamber by detuning the starting circuit after initiation of the arc discharge. By extinguishing the discharge in the starting chamber, the flow of currents between the low-pressure starting discharge chamber and the arc tube, which would otherwise eventually have a detrimental effect on the arc tube wall, is avoided.

Although the hereinabove described circuits for ensuring the suppression of the discharge in the starting chamber are effective, it may be desirable to provide an improved gas probe starter which does not require additional circuitry to extinguish the discharge in the starting chamber.

SUMMARY OF THE INVENTION

The fill of a self-extinguishing gas probe starter for an electrodeless HID lamp includes a starter fill component which has a relatively low vapor pressure and is substantially inert in the starter fill at ambient temperatures, but which component vaporizes and becomes electronegative as the temperature of the lamp increases, so that the starter fill component attaches electrons of the starting discharge in the gas probe starter and thereby extinguishes the starting discharge after initiation of the arc discharge in the arc tube. Suitable starter fill components include iodine and sulfur. Alternatively, suitable starter fill components include elements or compounds (for example, halides such as iodides, bromides, chlorides and fluorides) which produce an electronegative vapor-phase constituent at lamp-operating temperatures, but do not produce an electronegative specie at expected ambient temperatures, i.e., before starting.

BRIEF DESCRIPTION OF THE DRAWINGS

The features and advantages of the present invention will become apparent from the following detailed description of the invention when read with the sole accompanying drawing FIGURE which illustrates an electrodeless HID lamp employing a self-extinguishing gas probe starter of the present invention.

DETAILED DESCRIPTION OF THE INVENTION

The drawing FIGURE illustrates an electrodeless HID lamp 10 employing a gas probe starter 12 in accordance with a preferred embodiment of the present invention. Lamp 10 includes an arc tube 14 preferably formed of a high temperature glass, such as fused quartz, or an optically transparent or translucent ceramic, such as polycrystalline alumina. Typically, as shown, a light-transmissive envelope 15 surrounds arc tube 14. An excitation coil 16 is disposed about arc tube 14, i.e., outside envelope 15, and is coupled to a radio frequency (RF) ballast 18 for exciting a toroidal arc discharge 20 therein. By way of example, arc tube 14 is shown as having a substantially ellipsoid shape. However, arc tubes of other shapes may be desirable, depending upon the application. For example, arc tube 14 may be spherical or may have the shape of a short cylinder, or "pillbox", having rounded edges, if desired.

Arc tube 14 contains a fill in which an arc discharge having a substantially toroidal shape is excited during lamp operation. A suitable fill is described in U.S. Pat. No. 4,810,938 of P. D. Johnson, J. T. Dakin and J. M. Anderson, issued on Mar. 7, 1989, and assigned to the instant assignee. The fill of the Johnson et al. patent comprises a sodium halide, a cerium halide and xenon combined in weight proportions to generate visible radiation exhibiting high efficacy and good color rendering capability at white color temperatures. For example, such a fill according to the Johnson et al. patent may comprise sodium iodide and cerium chloride, in equal weight proportions, in combination with xenon at a partial pressure of about 500 torr. Another suitable fill is described in commonly assigned U.S. Pat. No. 4,972,120 of H. L. Witting, issued Nov. 20, 1990, which patent is incorporated by reference herein. The fill of the Witting patent comprises a combination of a lanthanum halide, a sodium halide, a cerium halide and xenon or krypton as a buffer gas. For example, a fill according to the Witting patent may comprise a combination of lanthanum iodide, sodium iodide, cerium iodide, and 250 torr partial pressure of xenon.

As illustrated in the drawing FIGURE, RF power is applied to the HID lamp by RF ballast 18 via excitation coil 16 coupled thereto. Excitation coil 16 is illustrated as comprising a two-turn coil having a configuration such as that described in U.S. Pat. No. 5,039,903 of G. A. Farrall issued Aug. 13, 1991, which is incorporated by reference herein. Such a coil configuration results in very high efficiency and causes only minimal light blockage from the lamp. The overall shape of the excitation coil of the Farrall patent is generally that of a surface formed by rotating a bilaterally symmetrical trapezoid about a coil center line situated in the same plane as the trapezoid, but which line does not intersect the trapezoid. However, other suitable coil configurations may be used with the starting aid of the present invention, such as that described in commonly assigned U.S. Pat. No. 4,812,702 of J. M. Anderson, issued Mar. 14, 1989, which patent is incorporated by reference herein. In particular, the Anderson patent describes a coil having six turns which are arranged to have a substantially V-shaped cross section on each side of a coil center line. Still another suitable excitation coil may be of solenoidal shape, for example.

In operation, RF current in coil 16 results in a time-varying magnetic field which produces within arc tube 14 an electric field that completely closes upon itself. Current flows through the fill within arc tube 14 as a result of this solenoidal electric field, producing toroidal arc discharge 20 therein. Suitable operating frequencies for RF ballast 18 are in the range from 0.1 to 300 megahertz (MHz), exemplary operating frequencies being 6.78 MHz and 13.56 MHz.

As shown in the drawing FIGURE, gas probe starter 12 comprises a starting electrode 30 coupled to a starting chamber 34 which is attached to the outer wall of arc tube 14 and contains a starter fill. Specifically, starting electrode 30 is shown being situated about chamber 34 and in contact therewith. However, other suitable gas probe starter configurations (not shown) include situating the electrode either within the interior of the chamber or outside the chamber, but in close proximity thereto.

The starter fill in starting chamber 34 may comprise, for example, a rare gas, such as neon, krypton, xenon, argon, helium, or mixtures thereof, at a pressure in the range from approximately 0.5 to 500 torr, a preferred range being from approximately 5 to 40 torr. Preferably, the gas in chamber 34 is at a relatively low pressure as compared with that of the arc tube fill in order to promote even easier starting. For example, a suitable arc tube fill pressure may be approximately 200 torr while that of the gas in chamber 34 may be approximately 20 torr.

In order to start lamp 10, a starting voltage is applied to electrode 30 via a starting circuit 40, causing the gas in chamber 34 to break down, or ionize, and thus become conductive. The discharge in the starting chamber may be characterized as either a glow discharge or an arc discharge, depending upon the pressure of the gas and the electric current in chamber 34. At the low-end of the aforementioned gas pressure range, the discharge is more likely to be characterized as a glow, while at the high-end of the gas pressure range, the discharge is more likely to be characterized as an arc. However, there is no generally accepted definition which distinguishes between glow and arc discharges. For example, as described by John H. Ingold in "Glow Discharges at DC and Low Frequencies" from *Gaseous Electronics*, vol. I, edited by M. N. Hirsh and H. J. Oskam, Academic Press, New York, 1978, pp. 19–20, one definition is based on electrode-related phenomena, and another is based on electron and particle temperatures.

As a result of the discharge current in starting chamber 34, a sufficiently high starting voltage is capacitively coupled to the inside surface of arc tube 14 which causes the high-pressure gaseous fill contained therein to break down, thereby initiating arc discharge 20. As described hereinabove, suitable starting circuits for coupling a starting voltage to a gas probe starter are described in Cocoma et al. U.S. patent application Ser. No. 622,024 and in Farrall et al. U.S. Pat. No. 5,057,750. Once the arc discharge is initiated, the starting voltage is either removed from starting electrode 30, or the magnitude thereof is decreased to a sufficiently low value, so that the discharge current in chamber 34 is extinguished. That is, the gas contained in chamber 34 becomes essentially nonconductive, thus providing a high-impedance path between starting electrode 30 and arc tube 14. In this way, the arc tube is protected during lamp operation from capacitively coupled currents which would otherwise flow between the starting electrode and the arc tube and have a detrimental effect on the arc tube wall. According to the cited references, as described hereinabove, additional circuitry is required to ensure suppression of the discharge in the low-pressure starting chamber by detuning the starting circuit after initiation of the arc discharge.

In accordance with the present invention, the starting chamber fill includes a starter fill component which has a substantially low vapor pressure and is substantially inert in the starter fill at ambient temperatures, but which component vaporizes and becomes electronegative as the temperature of the lamp increases so that the starter fill component attaches electrons of the starting discharge and thereby extinguishes the starting discharge after initiation of the arc discharge in the arc tube. Hence, the gas probe starter of the present invention does not require additional circuitry to suppress the starting discharge.

A suitable starter fill component according to the present invention includes, for example, iodine or sulfur. Other suitable starter fill components include elements or compounds (for example, halides such as iodides, bromides, chlorides and fluorides) which provide an electronegative vapor-phase constituent at probe-operating temperatures, for example in the range from somewhat above ambient temperatures to about 1000° C. One suitable halide is mercury iodide. The electronegative constituent might result from simple vaporization or from ionization and/or dissociation processes consequent to the starting probe discharge. A principal constraint is that the starter fill component not produce an electronegative specie at expected ambient temperatures, i.e., before starting.

By way of example, one or more iodine particles (e.g., flakes) may be added to the gas probe starter fill. Before lamp-starting, the iodine exists in essentially solid form within the starting chamber of the gas probe starter. After application of a starting voltage to the probe, a starting voltage is established to start the lamp, i.e., initiate an arc discharge in the arc tube via a starting discharge in the starting chamber, as described hereinabove. Meanwhile, in the starting chamber, the starting and arc discharges cause heating and vaporization of the iodine. In the vapor phase, iodine is electronegative. As a result, the iodine attaches electrons from the starting discharge, thereby "starving" the starting discharge which thus extinguishes.

Advantageously, the self-extinguishing gas probe starter of the present invention provides protection against hot restrike attempts. In particular, after the lamp has been turned off and is still hot, the gas probe starter of the present invention still has an electronegative vapor-phase constituent which prevents breakdown of the starter fill and hence avoids igniting a starting discharge which would otherwise eventually damage the arc tube wall at the location where the starting chamber and the arc tube are joined.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A gas probe starter for an electrodeless high intensity discharge lamp of the type having an excitation coil situated about an arc tube for exciting an arc discharge in an ionizable fill contained in said arc tube, comprising:

a starting chamber having a wall enclosing an interior containing a starter fill, said starting chamber being attached to the outer wall of said arc tube;

a starting electrode disposed proximate to the portion of said starting chamber opposite to the portion that is attached to said arc tube for coupling a starting voltage to the interior of said starting chamber;

means for coupling said starting voltage to said starting electrode for initiating a starting discharge in said starting chamber that in turn initiates an arc discharge in said arc tube; and said starter fill including electronegative means for extinguishing the starting discharge in said starting chamber after initiation of said arc discharge in said arc tube.

2. The gas probe starter of claim 1 wherein said electronegative means comprises a starter fill component that vaporizes as the temperature of the lamp increases, said starter fill component providing an electronegative vapor-phase constituent at probe operating temperatures.

3. The gas probe starter of claim 2 wherein said starter fill component comprises iodine.

4. The gas probe starter of claim 2 wherein said starter fill component comprises sulfur.

5. The gas probe starter of claim 2 wherein said starter fill component comprises a halide of the group consisting of iodides, bromides, chlorides and fluorides, including combinations thereof.

6. The gas probe starter of claim 5 wherein said starter fill component comprises mercury iodide.

7. An electrodeless high intensity discharge lamp, comprising:

an arc tube for containing an ionizable fill;

an excitation coil situated about said arc tube for exciting an arc discharge in said ionizable fill when coupled to a radio frequency power source;

a starting chamber having a wall enclosing an interior containing a starter fill, said starting chamber being attached to the outer wall of said arc tube;

a starting electrode disposed proximate to the portion of said starting chamber opposite to the portion that is attached to said arc tube for coupling a starting voltage to the interior of said starting chamber;

means for coupling said starting voltage to said starting electrode for initiating a starting discharge in said starting chamber that in turn initiates an arc discharge in said arc tube; and said starter fill including electronegative means for extinguishing the starting discharge in said starting chamber after initiation of said arc discharge in said arc tube.

8. The lamp of claim 7 wherein said electronegative means comprises a starter fill component that vaporizes as the temperature of the lamp increases, said starter fill component providing an electronegative vapor-phase constituent at probe operating temperatures.

9. The lamp of claim 8 wherein said starter fill component comprises iodine.

10. The lamp of claim 8 wherein said starter fill component comprises sulfur.

11. The lamp of claim 8 wherein said starter fill component comprises a halide of the group consisting of iodides, bromides, chlorides and fluorides, including combinations thereof.

12. The lamp of claim 11 wherein said starter fill component comprises mercury iodide.

13. The lamp of claim 7, further comprising a light-transmissive outer envelope spaced apart from and disposed between said arc tube and said excitation coil.

* * * * *